US005281378A

United States Patent [19]

Kozulla

[11] Patent Number: 5,281,378

[45] Date of Patent: Jan. 25, 1994

[54] PROCESS OF MAKING HIGH THERMAL BONDING FIBER

[75] Inventor: Randall E. Kozulla, Conyers, Ga.

[73] Assignee: Hercules Incorporated, Wilmington, Del.

[21] Appl. No.: 887,416

[22] Filed: May 20, 1992

Related U.S. Application Data

[63] Continuation of Ser. No. 474,897, Feb. 5, 1990, abandoned.

[51] Int. Cl.[5] ..... D01F 1/10; D01F 6/04; D01F 8/06; D01F 11/04

[52] U.S. Cl. ..... 264/83; 264/171; 264/211; 264/211.15; 264/237

[58] Field of Search ..... 264/83, 103, 171, 210.6, 264/211, 211.15, 237

[56] References Cited

U.S. PATENT DOCUMENTS

| | | |
|---|---|---|
| 2,335,922 | 12/1943 | Dreyfus . |
| 2,715,075 | 8/1955 | Wolinski . |
| 2,715,076 | 8/1955 | Wolinski . |
| 2,715,077 | 8/1955 | Wolinski . |
| 2,985,995 | 5/1961 | Bunting, Jr. et al. . |
| 3,364,537 | 1/1968 | Bunting, Jr. et al. . |
| 3,428,506 | 2/1969 | Johnstone . |
| 3,484,916 | 12/1969 | Johnstone . |
| 3,505,164 | 4/1970 | Oppenlander . |
| 3,509,013 | 4/1970 | Oppenlander . |
| 3,516,899 | 6/1970 | Saunders . |
| 3,533,904 | 10/1970 | Jurkiewitsch . |
| 3,597,268 | 8/1971 | Smith . |
| 3,616,168 | 8/1971 | Johnstone . |
| 3,663,675 | 5/1972 | Fukuma et al. . |
| 3,693,341 | 9/1972 | Higgins, Jr. . |
| 3,807,917 | 4/1974 | Shimoda et al. . |
| 3,862,265 | 1/1975 | Steinkamp et al. ..... 425/376.1 |
| 3,898,209 | 8/1975 | Watson et al. . |
| 3,907,057 | 9/1975 | Reddekopp . |
| 3,907,957 | 9/1975 | Shaffer . |
| 4,115,620 | 9/1978 | Gupta et al. . |
| 4,134,882 | 1/1979 | Frankfort et al. . |
| 4,193,961 | 3/1980 | Roberts . |
| 4,195,051 | 3/1980 | Frankfort et al. . |
| 4,251,200 | 2/1981 | Parkin . |
| 4,259,399 | 3/1981 | Hill . |
| 4,303,606 | 12/1981 | Roberts . |
| 4,347,206 | 8/1982 | Roberts . |
| 4,438,238 | 3/1984 | Fukushima et al. . |
| 4,480,000 | 10/1984 | Watanabe et al. . |
| 4,500,384 | 2/1985 | Tomioka et al. . |
| 4,511,615 | 4/1985 | Ohta . |
| 4,578,414 | 3/1986 | Sawyer et al. . |
| 4,592,943 | 6/1986 | Cancian et al. . |
| 4,626,467 | 12/1986 | Hostetter . |
| 4,632,861 | 12/1986 | Vassilatos . |
| 4,634,739 | 1/1987 | Vassilatos . |
| 4,680,156 | 7/1987 | Collier . |
| 4,717,325 | 1/1988 | Fujimura et al. . |
| 4,770,925 | 9/1988 | Uchikawa et al. ..... 428/219 |
| 4,804,577 | 2/1989 | Hazelton et al. . |
| 4,828,911 | 5/1989 | Morman . |
| 4,830,904 | 5/1989 | Gessner et al. . |
| 4,840,847 | 6/1989 | Ohmae et al. . |
| 4,842,922 | 6/1989 | Krupp et al. . |
| 4,874,666 | 10/1989 | Kubo et al. . |
| 4,883,707 | 11/1989 | Newkirk . |
| 4,909,976 | 3/1990 | Cuculo et al. . |
| 5,009,951 | 4/1991 | Ohmae et al. . |
| 5,066,723 | 11/1991 | Randall, Jr. et al. . |

FOREIGN PATENT DOCUMENTS

| | | |
|---|---|---|
| 279511 | 8/1988 | European Pat. Off. . |
| 445536 | 9/1991 | European Pat. Off. . |

(List continued on next page.)

OTHER PUBLICATIONS

Fan et al. "Effects of Molecular Weight Distribution on the Melt Spinning of Polypropylene Fibers", *Journal of Polymer Engineering*, vol. 5, No. 2 (1985) pp. 95–123.

(List continued on next page.)

*Primary Examiner*—Leo B. Tentoni

[57] ABSTRACT

High strength spun melt fiber is prepared by utilizing threadline oxidative chain scission degradation of hot fiber spun from polymer component(s) having a broad molecular weight distribution in conjunction with a delayed quench step.

66 Claims, 1 Drawing Sheet

FOREIGN PATENT DOCUMENTS

| | | |
|---|---|---|
| 1142065 | 9/1957 | France . |
| 1146080 | 11/1957 | France . |
| 48-18519 | 3/1973 | Japan . |
| 63-061038A | 3/1988 | Japan . |
| 63-168445A | 7/1988 | Japan . |
| 03-92416 | 4/1991 | Japan . |
| 34908 | 1/1957 | Luxembourg . |
| 738474 | 10/1955 | United Kingdom . |
| 2121423 | 12/1983 | United Kingdom . |

OTHER PUBLICATIONS

Jeffries, R. "Biocomponent Fibers", Morrow Monograph Publ. Co. 71 (1971).

English Language abstract of Japanese Patent 63-061038 to Mitsubishi Petrochemical K.K. (Mar. 17, 1988).

English Language abstract of Japanese Patent 63-168445 to Chisso Corp. (Jul. 12, 1988).

Deopura et al., "A Study of Blends of Different Molecular Weights of Polypropylene" *Journal of Applied Polymer Science*, vol. 31, 2145-2155 (1986).

Legare, 1986 TAPPI Synthetic Fibers For Wet System and Thermal Bonding Applications, Boston Park Plaza Hotel & Towers, Boston, Mass., Oct. 9-10, 1986, "Thermal Bonding of Polypropylene Fibers in Nonwovens", pp. 1-13 and attached Tables and Figures.

Kloos, The Plastics and Rubber Institute, The Conference Department, Fourth International Conference On Polypropylene Fibers And Textiles, East Midlands Conference Centre, Nottinghas, London, UK: Wednesday 23 to Friday 25 Sep. 1987, "Dependence of Structure and Properties of Melt Spun Polypropylene".

Jones, The Plastics and Rubber Institute, The Conference Department, Fourth International Conference on Polypropylene Fibers and Textiles, East Midlands Conference Centre, Nottinghas, London, UK: Wednesday 23 to Friday 25 Sep. 1987, "A Study of Resin Melt Flow Rate and Polydispersity Effects on the Mechanical Properties of Melt Blown Polypropylene Webs", pp. i and 46/1-46/10.

Mahajan et al., "Fibers Spun From Blends of Different Molecular Weights of Polypropylene", *Journal of Applied Polymer Science*, vol. 43, 49-56 (1991).

Seiler and Goller, "Propylene (PP)" *Kunststoffe* 80 (1990) 10, pp. 1085-1092.

Trent et al., "Ruthenium Tetroxide Staining of Polymers for Election Microscopy" *Macromolecules*, vol. 16 No. 4, 1983.

Zeichner and Patel, *Proceedings of Second World Congress of Chemical Engineering, Montreal*, vol. 6 (1981) pp. 333-337.

McDonald, "Short Spin Systems", *Fiber Producer*, Aug. 1983, pp. 38-66.

Durcova, O. et al. "Structure of Photooxidized Polypropylene Fibers". *Polymer Science U.S.S.R.*, vol. 29, No. 10 (1987), pp. 2351-2357.

PROCESS OF MAKING HIGH THERMAL BONDING FIBER

This application is a continuation of application Ser. No. 07/474,897, filed Feb. 5, 1990, now abandoned.

BACKGROUND

A number of modern uses have been found for nonwoven materials produced from melt spun polymers, particularly degraded polyolefin-containing compositions. Such uses, in general, demand special properties of the nonwoven and corresponding fiber such as special fluid handling, high vapor permeability, softness, integrity and durability, as well as efficient cost-effective processing techniques.

Unfortunately, however, the achievement of properties such as softness, and vapor-permeability, for example, present serious largely unanswered technical problems with respect to strength, durability and efficiency of production of the respective staple and nonwoven products.

One particularly troublesome and long standing problem in this general area stems from the fact that efficient, high speed spinning and processing of polyolefin fiber such as polypropylene requires careful control over the degree of chemical degradation and melt flow rate (MFR) of the spun melt, and a highly efficient quenching step capable of avoiding substantial over- or under-quench leading to melt fracture or ductile failure under high speed commercial manufacturing conditions. The resulting fiber can vary substantially in bonding properties.

It is an object of the present invention to improve control over polymer degradation, spin and quench steps so as to obtain fiber capable of producing nonwoven fabric having increased strength, toughness, and integrity.

It is a further object to improve the heat-bonding properties of fiber spun from polyolefin-containing melt such as polypropylene polymer or copolymer.

THE INVENTION

The above objects are realized by use of the instant process whereby monocomponent or bicomponent fiber having improved heat bonding properties and material strength, elongation, and toughness is obtained by A. admixing an effective amount of at least one antioxidant/stabilizer composition into a dry melt spun mixture comprising broad molecular weight distribution polyolefin polymer or copolymer, such as polypropylene as hereafter defined, in the presence of an active amount of a degrading composition; various other additives known to the spinning art can also be incorporated, as desired, such as pigments and art-known whiteners and colorants such as $TiO_2$ and pH-stabilizing agents such as calcium stearate in usual amounts (i.e. 1%–10% or less).

B. heating and spinning the resulting spun melt mixture, at a temperature, preferably within a range of about 250°–325° C., and in an environment under sufficient pressure to minimize or control oxidative chain scission degradation of polymeric component(s) within said spun mixture prior to and during said spinning step;

C. taking up the resulting hot (essentially unquenched) spun fiber under an oxygen-containing atmosphere maximizing gas diffusion into the hot fiber to effect threadline oxidative chain scission degradation of the fiber; and D. quenching and finishing the resulting partially degraded spun fiber to obtain a raw spun fiber having a highly degraded surface zone of low molecular weight, low birefringence, and a minimally degraded, essentially crystalline birefringent inner configuration, these two zones representing extremes defining an intermediate zone (see below) having a gradation in oxidative degradation depending generally upon fiber structure and rate of diffusion of oxidant into the hot fiber.

The resulting fiber or filament is further characterized as the spun product of a broad molecular weight polyolefin polymer or copolymer, preferably a polypropylene-containing spun melt having incorporated therein an effective amount of at least one antioxidant/stabilizer composition, the resulting fiber or filament, when quenched, comprising, in combination, (a) an inner zone identified by minimal oxidative polymeric degradation, high birefringence, and a weight average molecular weight within a range of about 100,000–450,000 and preferably about 100,000–250,000;

(b) an intermediate zone generally externally concentric to the inner zone and further identified by progressive (inside-to-outside) oxidative chain scission degradation, the polymeric material within the intermediate zone having a molecular weight gradation within a range of about 100,000–450,000-to- less than 20,000 and preferably about 10,000–20,000; and (c) a surface zone generally externally concentric to the intermediate zone and defining the external surface of the fiber or filament, the surface zone being further identified by low birefringence, a high concentration of oxidative chain scission degraded polymeric material, and a weight average molecular weight of less than about 10,000 and preferably about 5,000–10,000.

Further, the characteristics of the inner zone, the surface zone and the graduated intermediate zone can be defined using terminology which is related to the weight average molecular weight. For example, the various zones can be defined using the melt flow rate of the polymer. In this regard, as the molecular weight decreases towards the surface o the fiber, there will be a corresponding increase in the melt flow rate.

For present purposes the term "effective amount", as applied to the concentration of antioxidant/stabilizer compositions within the dry spun melt mixture, is defined as an amount, based on dry weight, which is capable of preventing or at least substantially limiting chain scission degradation of the hot polymeric component(s) within fiber spinning temperature ranges in the substantial absence of oxygen, an oxygen evolving, or an oxygen-containing gas. In particular, it refers to a concentration of one or more antioxidant compositions sufficient to effectively limit chain scission degradation of polyolefin component of a heated spun melt composition within a temperature range of about 250° C. to about 325° C., in the substantial absence of an oxidizing environment such as oxygen, air or other oxygen/nitrogen mixtures. The above definition, however, permits a substantial amount of oxygen diffusion and oxidative polymeric degradation to occur, commencing at or about the melt zone of the spun fiber threadline and extending downstream, as far as desired, to a point where natural heat loss and/or an applied quenching environment lowers the fiber surface temperature (to about 250° C. or below, in the case of polypropylene polymer or copolymer)to a point where further oxygen diffusion into the spun fiber or filament is negligible.

Generally speaking, the total combined antioxidant/-stabilizer concentration usually falls within a range of about 0.002%-1% by weight, and preferably within a range of about 0.005%-0.5%, the exact amount depending on the particular theological and molecular properties of the chosen broad molecular weight polymeric component(s) and the temperature of the spun melt; additional parameters are represented by temperature and pressure within the spinnerette itself, and the amount of prior exposure to residual amounts of oxidant such as air while in a heated state upstream of the spinnerette. Below or downstream of the spinnerette an oxygen/nitrogen gas flow ratio of about 100-10/0-90 by volume at an ambient temperature up to about 200° C. plus a delayed quench step are preferred to assure adequate chain scission degradation of the polymer component and to provide improved thermal bonding characteristics, leading to increased strength, elongation and toughness of nonwovens formed from the corresponding continuous fiber or staple.

The term "active amount of a degrading composition" is here defined as extending from 0% up to a concentration, by weight, sufficient to supplement the application of heat to a spun melt mix and the choice of polymer component and arrive at a spinnable (resin) MFR value (preferably within a range of about 5 to 35). Assuming the use of broad molecular weight polypropylene-containing spun melt, an "active amount" constitutes an amount which, at a melt temperature range of about 275°-320° C. and in the substantial absence of oxygen or oxygen-containing or -evolving gas, is capable of producing or obtaining a spun melt within the above-stated desirable MFR range.

The term "antioxidant/stabilizer composition", as here defined, comprises one or more art-recognized antioxidant compositions employed in effective amounts as below-defined, inclusive of phenylphosphites such as Irgafos® 168, Ultranox® 626(*), Sandostab PEP-Q (*3); N,N'bis-piperidinyl diamine-containing compositions such as Chimassorb® 119 or 944(); hindered phenolics such as Cyanox® 1790(), Irganox® 1076 or 1425 and the like.

(*) commercially obtainable as products of Ciba Geigy Corp.
(**) commercially obtainable as products of American Cyanamid Co.
(*3) Commercially obtainable as a product of Sandos chemical Co.

The term "broad molecular weight distribution", is here defined as dry polymer pellet, flake or grain preferably having an MWD value (i.e. Wt.Av.Mol.Wt./No.Av.Mol.Wt.) of not less than about 5.5.

The term "quenching and finishing", as here used, is defined as a process step generic to one or more of the steps of gas quench, fiber draw (primary and secondary if desired) and texturing, (optionally inclusive of one or more of the routine steps of bulking, crimping, cutting and carding), as desired.

The spun fiber obtained in accordance with the present invention can be continuous and/or staple fiber of a (1) monocomponent- or (2) bicomponent-type, the inner zone, in the former, having a relatively high crystallinity and birefringence with a negligible or very modest oxidative chain scission degradation.

In the latter (2) bicomponent type, the corresponding inner layer of the sheath element is comparable to the center cross sectional area of a monocomponent fiber, however, the bicomponent core element of a bicomponent fiber is not necessarily treated in accordance with the instant process or even consist of the same polymeric material as the sheath component, although generally compatible with or wettable by Lk the inner zone of the sheath component.

The sheath and core elements of bicomponent fiber within the present invention can be conventionally spun in accordance with equipment known to the bicomponent fiber art(*4) except for the preferred use of nitrogen or other inert gas environment to avoid or minimize oxygen diffusion into the hot spun melt or the hot core element prior to application of a sheath element around it. In the latter (2) situation (see FIG. 2 below), the sheath element should possess (a') an inner, essentially crystalline birefringent, non degraded zone contacting the bicomponent core, (b') an intermediate zone of indeterminate thickness and intermediate crystallinity and birefringence, and (c') a highly degraded bicomponent fiber surface zone, the three zones being comparable to the above-described three zones of a monocomponent fiber (see FIG. 1 below).

(*4) See, for instance, U.S. Pat. Nos. 3,807,917, 4,251,200 4,717,325 and "bicomponent Fibers"—R. Jeffries; Merrow Mionograph Publishing Company, Pub. 1971

As above noted, the instant invention does not necessarily require the addition of a conventional polymer degrading agent in the spun melt mix, although such use is not precluded by this invention in cases where a low spinning Z11190 temperature and/or pressure is preferred, or if, for other reasons, the MFR value of the heated polymer melt is otherwise too high for efficient spinning. In general, however, a suitable MFR (melt flow rate) for initial spinning purposes is best obtained by careful choice of a broad molecular weight polyolefin-containing polymer to provide the needed theological and morphological properties when operating within a spun melt temperature range of about 275°-320° C. for polypropylene.

DESCRIPTION OF DRAWINGS

Some of the features and advantages of the instant invention are further represented in FIGS. 1 and 2 as schematic cross sections of filament or fiber treated in accordance with applicant's process.

Figure 1:
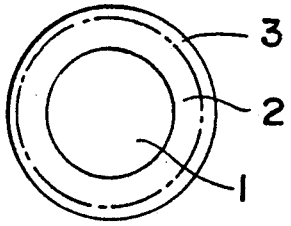
FIG. 1, as shown and above noted represents a monocomponent-type filament or fiber and FI"G. 2 represents a bicomponent-type filament or fiber (neither shown to scale) in which "(3)" of FIG. 1 represents an approximate oxygen-diffused surface zone characterized by highly degraded polymer of less than about 10,000 (wt Av MW) and preferably falling within a range of about 5,000-10,000 and at least initially with a high schematic and/or beta crystal configuration; "(2)" represent an intermediate zone, preferably one having a polymer component varying from about 450,000-to-about 10,000-20,000 (inside-to-outside), the thickness and steepness of the decomposition gradient depending substantially upon the extended maintenance of fiber heat, initial polymer MWD, the rate of oxidant gas diffusion, plus the relative amount of oxygen residually present int h dry spun mix which diffuses into the hot spun fiber upstream, during spinning and prior to the take up and quenching steps; inner zone "(1)", on the other hand, represents an approximate zone of relatively high birefringence and minimal oxidative chain scission due to a low or nonexistent oxygen concentration. As earlier noted, this zone usefully has a molecular weight within a range of about 100,000-450,000.

The above three zones within FIG. 1 as previously noted are representative of a monocomponent fiber but such zones are usually not visually apparent in actual test samples, nor do they necessarily represent an even depth of oxygen diffusion throughout the treated fiber.

Figure 2:
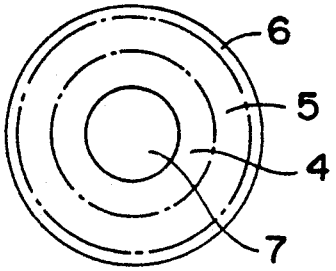

FIG. 2 represents a bicomponent-type fiber also within the scope of the present invention, in which (4), (5) and (6) are defined substantially as counterparts of 1-3 of FIG. 1 while (7) represents a bicomponent core zone which, if desired, can be formed from a separate spun melt composition obtained and applied using a s pack in a conventional manner (*4), provided inner layer (4) consists of a compatible (i.e. core-wettable) material. In addition, zone (7) is preferably formed and initially sheath-coated in a substantially nonoxidative environment in order to minimize the formation of a low-birefringent low molecular weight interface between zones (7) and (4).

As before, the quenching step of the spun bicomponent fiber is preferably delayed at the threadline, conveniently by partially blocking the quench gas, and air, ozone, oxygen, or other conventional oxidizing environment (heated or ambient temperature) is provided downstream of the spinnerette, to assure sufficient oxygen diffusion into the sheath element and oxidative chain scission within at least surface zone (6) and preferably both (6) and (5) zones of the sheath element.

Yarns as well as webs for nonwoven material are conveniently formed from fibers or filaments obtained in accordance with the present invention by jet bulking, cutting to staple, crimping and laying down the fiber or filament in conventional ways and as demonstrated, for instance, in U.S. Pat. Nos. 2,985,995, 3,364,537, 3,693,341, 4,500,384, 4,511,615, 000, and 4,592,943.

While FIGS. 1 and 2 show generally circular fiber cross sections, the present invention is not limited to such configuration, conventional diamond, delta, oval, "Y" shaped, "X" shaped cross sections and the like are equally applicable to the instant invention.

The present invention is further demonstrated, but not limited to the following Examples:

EXAMPLE I

Dry melt spun compositions identified hereafter as SC-1 through SC-12 are individually prepared by tumble mixing linear isotactic polypropylene flake identified as "A"-"D" in Table I*5 and having Mw/Mn values of about 5.4 to 7.8 and a Mw range of 195,000-359,000, which are admixed respectively with about 0.1% by weight of conventional stabilizer(s)(*1). The mix is then heated and spun as circular cross section fiber at a temperature of about 300° C. under a nitrogen atmosphere, using a standard 782 hole spinnerette at a speed of 750-1200 M/m. The fiber thread lines in the quench box are exposed to a normal ambient air quench (cross blow) with up to about 5.4% of the upstream jets in the quench box blocked off to delay the quenching step. The resulting continuous filaments, having spin denier within a range of 2.0-2.6 dpf, are then drawn (1.0 to 2.5X), crimped (stuffer box steam), cut to 1.5 inches, and carded to obtain conventional fiber webs. Three ply webs of each staple are identically oriented and stacked (machine direction), and bonded, using a diamond design calender at respective temperatures of about 157° C. or 165° C., and 240 PLI (pounds/linear inch) to obtain test nonwovens weighing 17.4-22.8 gm/yd$^2$. Test strips of each nonwoven (1"×7") are then identically conventionally tested for CD strength* elongation and toughness*7. The fiber parameters and fabric strength are reported in Tables II-IV below using the polymers described in Table I in which the "A" polymers are used as controls.

(*5) Obtained commercially from Himont Incorporated
(*6) Using a tensile tester of Instron Incorporated.
(*7) Energy required to break fabric conventionally, based on stress/strain curve values.

EXAMPLE 2 (Controls)

Example I is repeated, utilizing polymer A and/or other polymers with a low Mw/Mn of 5.35 and/or full (non-delayed) quench. The corresponding webs and test nonwovens are otherwise identically prepared and identically tested as in Example 1. Test results of the controls, identified as C-1 through C-9 are reported in Tables II-IV.

TABLE I

| Spun Mix Polymer Identification | $\overline{M}w$ (g/mol) | Sec *8 $\overline{M}n$ (g/mol) | $\overline{M}w/\overline{M}n$ | Intrinsic Visc. IV (deciliters/g) | MFR (gm/10 min) |
|---|---|---|---|---|---|
| A | 229,000 | 42.900 | 5.35 | 1.85 | 13 |
| B | 359,000 | 46,500 | 7.75 | 2.6 | 5.5 |
| C | 290,000 | 44,000 | 6.59 | 2.3 | 8 |
| D | 300,000 | 42,000 | 7.14 | 2.3 | 8 |

*8 Size exclusion chromatography.

TABLE II

| Melt Sample | Polymer | MWD | Spin Temp °C. | Area % Quench Box* Blocked Off | Comments |
|---|---|---|---|---|---|
| C-1 | A | 5.35 | 298 | 3.74 | Control |
| SC-1 | C | 6.59 | 305 | 3.74 | >5.5 MWD |
| SC-2 | D | 7.14 | 309 | 3.74 | >5.5 MWD |
| SC-3 | B | 7.75 | 299 | 3.74 | >5.5 MWD |
| C-2 | A | 5.35 | 298 | 3.74 | Control < 5.5 MWD |
| C-3 | A | 5.35 | 300 | 3.74 | Control < 5.5 MWD |
| C-4 | A | 5.35 | 298 | 3.74 | Control < 5.5 MWD |
| SC-4 | D | 7.14 | 309 | 3.74 | No stabilizer |
| SC-5 | D | 7.14 | 312 | 3.74 | — |
| SC-6 | D | 7.14 | 314 | 3.74 | — |
| SC-7 | D | 7.14 | 309 | 3.74 | — |
| SC-8 | C | 6.59 | 305 | 5.38 | |
| SC-9 | C | 6.59 | 305 | 3.74 | |
| C-5 | C | 6.59 | 305 | 0 | Control/Full Quench |
| C-6 | A | 5.35 | 290 | 5.38 | Control < 5.5 MWD |
| C-7 | A | 5.35 | 290 | 3.74 | Control < 5.5 MWD |
| C-8 | A | 5.35 | 290 | 0 | Control < 5.5 MWD |
| SC-10 | D | 7.14 | 312 | 3.74 | |
| C-9 | D | 7.14 | 312 | 0 | Control/Full Quench |
| SC-11 | B | 7.75 | 278 | 4.03 | — |
| SC-12 | B | 7.75 | 299 | 3.74 | — |

TABLE II-continued

| Melt Sample | Polymer | MWD | Spin Temp °C. | Area % Quench Box* Blocked Off | Comments |
|---|---|---|---|---|---|
| SC-13 | B | 7.75 | 300 | 3.74 | — |

TABLE III

| Melt Sample | FIBER PROPERTIES MFR (dg/min) | MWD | dpf | Tenacity (g/den) | Elongation % | Comments |
|---|---|---|---|---|---|---|
| C-1 | 25 | 4.2 | 2.50 | 1.90 | 343 | Effect of MWD |
| SC-1 | 25 | 5.3 | 2.33 | 1.65 | 326 | |
| SC-2 | 26 | 5.2 | 2.19 | 1.63 | 341 | |
| SC-3 | 15 | 5.3 | 2.14 | 2.22 | 398 | |
| C-2 | 17 | 4.6 | 2.28 | 1.77 | 310 | Additives |
| C-3 | 14 | 4.6 | 2.25 | 1.74 | 317 | Effect |
| C-4 | 21 | 4.5 | 2.48 | 1.92 | 380 | Low MWD |
| SC-4 | 35 | 5.4 | 2.28 | 1.59 | 407 | High MWD |
| SC-5 | 22 | 5.1 | 2.33 | 1.64 | 377 | Additives |
| SC-6 | 14 | 5.6 | 2.10 | 1.89 | 357 | Effect |
| SC-7 | 17 | 5.6 | 2.48 | 1.54 | 415 | |
| SC-8 | 23+ | 5.3 | 2.64 | 1.50 | 327 | Quench |
| SC-9 | 25 | 5.3 | 2.33 | 1.65 | 326 | Delay |
| C-5 | 23 | 5.3 | 2.26 | 1.93 | 345 | |
| C-6 | 19 | 4.5 | 2.28 | 1.81 | 360 | Quench |
| C-7 | 17 | 4.5 | 2.26 | 1.87 | 367 | Delay |
| C-8 | 18 | 4.5 | 2.28 | 1.75 | 345 | |
| SC-10 | 22 | 5.1 | 2.33 | 1.64 | 377 | Quench |
| C-9 | 15 | 5.2 | 2.18 | 1.82 | 430 | Delay |
| SC-11 | 11 | 5.4 | 2.40 | 2.00 | 356 | — |
| SC-12 | 15 | 5.3 | 2.14 | 2.22 | 398 | — |
| SC-13 | 24 | 5.1 | 2.59 | 1.65 | 4.18 | — |

TABLE IV

FABRIC CHARACTERISTICS (Variation in Calender Temperatures)

| Melt Sample | CALENDER Temp (°C.) | FABRIC Weight (g/sq yd.) | CDS (g/in.) | CDE (% in.) | TEA (g/in.) |
|---|---|---|---|---|---|
| C-1 | 157 | 22.8 | 153 | 51 | 42 |
| SC-1 | 157 | 21.7 | 787 | 158 | 704 |
| SC-2 | 157 | 19.2 | 513 | 156 | 439 |
| SC-3 | 157 | 18.7 | 593 | 107 | 334 |
| C-2 | 157 | 18.9 | 231 | 86 | 106 |
| C-3 | 157 | 21.3 | 210 | 73 | 83 |
| C-4 | 157 | 20.5 | 275 | 74 | 110 |
| SC-4 | 157 | 18.3 | 226 | 83 | 102 |
| SC-5 | 157 | 20.2 | 568 | 137 | 421 |
| SC-6 | 157 | 19.1 | 429 | 107 | 245 |
| SC-7 | 157 | 21 | 642 | 136 | 485 |
| SC-8 | 157 | 19.8 | 498 | 143 | 392 |
| SC-9 | 157 | 21.7 | 787 | 158 | 704 |
| C-5 | 157 | 19.4 | 467 | 136 | 350 |
| C-6 | 157 | 19.1 | 399 | 106 | 233 |
| C-7 | 157 | 19.8 | 299 | 92 | 144 |
| C-8 | 157 | 17.4 | 231 | 83 | 105 |
| SC-10 | 157 | 20.2 | 568 | 137 | 421 |
| C-9 | 157 | 20.4 | 448 | 125 | 300 |
| SC-11 | 157 | 19.4 | 274 | 86 | 122 |
| SC-12 | 157 | 18.7 | 593 | 107 | 334 |
| SC-13 | 157 | 19.4 | 688 | 132 | 502 |
| C-1 | 165 | 20.3 | 476 | 98 | 250 |
| SC-1 | 165 | 22.8 | 853 | 147 | 710 |
| SC-2 | 165 | 19 | 500 | 133 | 355 |
| SC-3 | 165 | 19.7 | 829 | 118 | 528 |
| C-2 | 165 | 18.8 | 412 | 120 | 262 |
| C-3 | 165 | 20.2 | 400 | 112 | 235 |
| C-4 | 165 | 20.6 | 453 | 102 | 250 |
| SC-4 | 165 | 19.3 | 400 | 110 | 239 |
| SC-5 | 165 | 17.9 | 614 | 151 | 532 |
| SC-6 | 165 | 19.9 | 718 | 142 | 552 |
| SC-7 | 165 | 20.5 | 753 | 157 | 613 |
| SC-8 | 165 | 20.4 | 568 | 149 | 468 |
| SC-9 | 165 | 22.8 | 853 | 147 | 710 |

TABLE IV-continued

FABRIC CHARACTERISTICS (Variation in Calender Temperatures)

| Melt Sample | CALENDER Temp (°C.) | FABRIC Weight (g/sq yd.) | CDS (g/in.) | CDE (% in.) | TEA (g/in.) |
|---|---|---|---|---|---|
| C-5 | 165 | 17.4 | 449 | 126 | 303 |
| C-6 | 165 | 18.5 | 485 | 117 | 307 |
| C-7 | 165 | 19.7 | 482 | 130 | 332 |
| C-8 | 165 | 19.2 | 389 | 103 | 214 |
| SC-10 | 165 | 17.9 | 614 | 151 | 532 |
| C-9 | 165 | 19.4 | 552 | 154 | 485 |
| SC-11 | 165 | 20.1 | 544 | 127 | 366 |
| SC-12 | 165 | 19.7 | 829 | 118 | 528 |
| SC-13 | 165 | 19.2 | 746 | 138 | 576 |

I claim:

1. A process for preparing at least one polypropylene containing fiber or filament, comprising:

extruding polypropylene containing material having a molecular weight distribution of at least about 5.5 to form at least one hot extrudate having a surface; and controlling quenching of the at least one hot extrudate in an oxygen containing atmosphere so as to effect oxidative chain emission degradation of the surface to obtain at least one polypropylene containing fiber or filament.

2. The process according to claim 1, wherein the polypropylene containing material has a molecular weight distribution of at least about 6.59.

3. The process according to claim 2, wherein the polypropylene containing material has a molecular weight distribution of at least about 7.14.

4. The process according to claim 3, wherein the polypropylene containing material has a molecular weight distribution of at least about 7.75.

5. The process according to claim 1, wherein the polypropylene containing material subjected to extrusion includes a member selected from the group consisting of antioxidants, stabilizers, and mixtures thereof.

6. The process according to claim 1, wherein the polypropylene containing material subjected to extrusion includes at least one of phenylphosphites and a N,N' bis-piperidinyl diamine derivative.

7. The process according to claim 1, wherein the polypropylene containing material is extruded from an extruder and includes a member selected from the group consisting of antioxidants, stabilizers, and mixtures thereof, in an effective amount to control chain scission degradation of polymeric components in the extruder.

8. The process according to claim 1, wherein the controlling quenching of the at least one hot extrudate in an oxygen containing atmosphere to effect oxidative chain scission degradation of the surface of the at least one fiber or filament includes controlling rate of quenching of the hot extrudate.

9. The process according to claim 8, wherein the controlling quenching comprises delaying quenching of the at least one hot extrudate.

10. The process according to claim 9, wherein the oxygen containing quenching atmosphere comprises a cross-blow quench, and an upper portion of the cross-blow quench is blocked.

11. The process according to claim 10, wherein up to about 5.4% of the cross-blow is blocked.

12. The process according to claim 8, wherein the controlling quenching includes immediately blocking an area as the at least one hot extrudate exits a spinnerette.

13. The process according to claims 1, wherein the at least one polypropylene containing fiber or filament comprises a monocomponent or a bicomponent fiber or filament.

14. The process according to claim 1, wherein the polypropylene containing material is extruded at a temperature of about 250° C. to 325° C.

15. The process according to claim 14, wherein the polypropylene containing material is extruded at a temperature of about 275° C. to 320° C.

16. The process according to claim 1, wherein the controlling quenching of the at least one hot extrudate in an oxygen containing atmosphere so as to effect oxidative chain scission of the surface comprises maintaining the temperature of the at least one hot extrudate above about 250° C. for a period of time to obtain oxidative chain scission degradation of the surface.

17. The process according to claim 16, wherein the controlling quenching includes blocking an upper portion of a cross-blow quench.

18. The process according to claim 16, wherein the controlling quenching includes passing the at least one hot extrudate through a blocked zone.

19. The process according to claim 18, wherein the blocked zone is open to the oxygen containing atmosphere.

20. The process according to claim 16, wherein the controlling quenching includes immediately blocking an area as the at least one hot extrudate exits a spinnerette.

21. A process for preparing at least one polypropylene containing fiber or filament, comprising:

extruding polypropylene containing material having a molecular weight distribution of at least about 5.5 to form at least one hot extrudate having a surface, the polypropylene containing material including a member selected from the group consisting of antioxidants, stabilizers, and mixtures thereof, in an effective amount to at least substantially limit chain scission degradation of polymeric components in the extruder; and controlling quenching of the at least one hot extrudate in an oxygen containing atmosphere so as to effect oxidative chain scission degradation of the surface, the controlling quenching including maintaining the at least one hot extrudate at a temperature for a sufficient period of time to permit oxidative chain scission degradation of the surface of the hot extrudate to obtain at least one polypropylene containing fiber or filament.

22. A process for preparing at least one polypropylene containing fiber or filament, comprising:

extruding polypropylene containing material having a molecular weight distribution of at least about 5.5 to form at least one hot extrudate having a surface; and controlling quenching of the at least one hot extrudate in an oxygen containing atmosphere so as to obtain at least one fiber or filament having a decreasing weight average molecular weight towards the surface of the at least one fiber or filament, and an increasing melt flow rate towards the surface of the at least one fiber or filament.

23. The process according to claim 22, wherein the at least one fiber or filament comprises an inner zone including a weight average molecular weight of about 100,000 to 450,000 grams/mole.

24. The process according to claim 23, wherein the inner zone comprises a weight average molecular weight of about 100,000 to 250,000 grams/mole.

25. The process according to claim 23, wherein the inner zone comprises a melt flow rate of about 5–35 dg/min.

26. The process according to claim 23, wherein the at least one fiber or filament comprises on a outer zone including the surface of the at least one fiber or filament, and the outer zone comprises a weight average molecular weight of less than about 10,000 rams/mole.

27. The process according to claim 26, wherein the outer zone comprises a weight average molecular weight of about 5,000 to 10,000 grams/mole.

28. The process according to claim 26, including an intermediate zone positioned between the inner zone and the outer zone having a weight average molecular weight and melt flow rate intermediate the inner zone and the outer zone.

29. The process according to claim 26, wherein the inner zone has a high birefringence, and the outer zone has a low birefringence.

30. The process according to claim 22, wherein the polypropylene containing material is extruded from an extruder and includes a member selected from the group consisting of antioxidants, stabilizers, and mixtures thereof, in an effective amount to control chain scission degradation of polymeric components of the hot extrudate in the extruder.

31. The process according to claim 22, wherein the at least one fiber or filament comprises a monocomponent or a bicomponent fiber or filament.

32. The process according to claim 22, wherein the at least one fiber or filament comprises an inner zone having a melt flow rate of 5–35 dg/min.

33. The process according to claim 22, wherein the polypropylene containing material has a molecular weight distribution of at least about 6.59.

34. The process according to claim 33, wherein the polypropylene contain material has a molecular weight distribution of at least about 7.14.

35. The process according to claim 34, wherein the polypropylene containing material has a molecular weight distribution of at least about 7.75.

36. A process for preparing at least one polypropylene containing fiber or filament, comprising:

extruding polypropylene containing material having a molecular weight distribution of at least about 5.5 to form at least one hot extrudate having a surface, the polypropylene containing material including a member selected from the group consisting of antioxidants, stabilizers, and mixtures thereof, in an effective amount to control chain scission degradation of polymeric components of the hot extrudate in the extruder; and controlling quenching of the at least one hot extrudate in an oxygen containing atmosphere so as to obtain at least one polypropylene containing fiber or filament having a decreasing weight average molecular weight towards the surface of the at least one fiber or filament, and an increasing melt flow rate towards the surface of the at least one fiber or filament, the at least one fiber or filament comprising an inner zone including a weight average molecular weight of about 100,000 to 450,000 rams/mole, and an outer zone, including the surface of the at least one fiber or filament, including a weight average molecular weight of less than about 10,000 grams/mole.

37. The process according to claim 36, wherein the fiber or filament includes an intermediate zone positioned between the inner zone and the outer zone having a weight average molecular weight and melt flow rate intermediate the inner zone and the outer zone.

38. The process according to claim 36, wherein the polypropylene containing material has a molecular weight distribution of at least about 6.59.

39. The process according to claim 38, wherein the polypropylene containing material has a molecular weight distribution of at least about 7.14.

40. The process according to claim 39, wherein the polypropylene containing material has a molecular weight distribution of at least about 7.75.

41. A process for preparing at least one polyolefin polymer containing fiber or filament, comprising:

extruding a mixture comprising a board molecular weight distribution polyolefin polymer and an effective amount of a member selected from the group consisting of antioxidants, stabilizers, and mixtures thereof under conditions to control oxidative chain scission degradation of polymeric components within the mixture prior to entering an oxygen containing atmosphere as a hot extrudate; and exposing the hot extrudate to an oxygen containing atmosphere under conditions to effect oxidative chain scission degradation of a surface of the hot extrudate to obtain at least one polyolefin polymer containing fiber or filament having a highly degraded surface zone of lower molecular weight compared to an inner zone of the hot extrudate.

42. The process according to claim 44, comprising controlling quenching of the resulting partially degraded extrudate to obtain a fiber or filament having a degraded surface zone of lower molecular weight, and the inner zone having higher molecular weight.

43. The process according to claim 42, wherein the mixture contains polypropylene, and has a molecular weight distribution of at least about 5.5.

44. The process according to claim 43, wherein the mixture has a molecular weight distribution of at least about 6.59.

45. The process according to claim 44, wherein the mixture has a molecular weight distribution of at least about 7.14.

46. The process according to claim 45, wherein the mixture has a molecular weight distribution of at least about 7.75.

47. The process according to claim 41, wherein the exposing of the hot extrudate to an oxygen containing atmosphere so as to effect oxidative chain scission of the surface comprises maintaining the temperature of the at least one hot extrudate above about 250° C. for a period of time to obtain oxidative chain scission degradation of the surface.

48. The process according to claim 47, wherein the controlling quenching includes blocking an upper portion of a cross-blow quench.

49. The process according to claim 47, wherein the controlling quenching includes passing the at least one hot extrudate through a blocked zone.

50. The process according to claim 49, wherein the blocked zone is open to the oxygen containing atmosphere.

51. A process for preparing at least one fiber or filament comprising:

extruding a broad molecular weight distribution polyolefin containing material at a temperature and an environment under conditions minimizing oxidative chain scission degradation of polymeric components within the extruder;

exposing resulting hot extrudate to an oxygen containing atmosphere to permit oxygen diffusion into the hot extrudate to obtain oxidative chain scission degradation of a surface of the resulting hot extrudate; and quenching the resulting hot extrudate to obtain at least one fiber or filament having a surface zone of lower molecular weight, and an inner zone having higher molecular weight than the surface zone.

52. The process according to claim 51, wherein the resulting hot extrudate is immediately exposed to an oxygen containing atmosphere.

53. The process according to claim 51, wherein the inner zone is substantially not degraded by oxygen.

54. The process according to claim 51, wherein the polyolefin containing material contains polypropylene, and has a molecular weight distribution of at least about 5.5.

55. The process according to claim 54, wherein the polyolefin containing material has a molecular weight distribution of at least about 6.59.

56. The process according to claim 55, wherein the polyolefin containing material has a molecular weight distribution of at least about 7.14.

57. The process according to claim 56, wherein the polyolefin containing material has a molecular weight distribution of at least about 7.75.

58. The process according to claim 57, wherein the resulting hot extrudate is immediately exposed to an oxygen containing atmosphere.

59. A process for preparing a fiber having improved heat bonding properties and material strength, elongation and toughness, comprising:

A. admixing an effective amount of at least one antioxidant/stabilizer composition into a dry melt spun mixture comprising a broad molecular weight distribution polyolefin polymer or copolymer, in the presence of an active amount of a degrading composition;

B. heating and spinning the resulting spun melt mixture at a temperature and in an environment under sufficient pressure, to minimize or control oxidative chain scission degradation of polymeric components within said spun mixture prior to completion of spinning;

C. taking up the remaining hot spun fiber under an oxygen-containing atmosphere maximizing gas diffusion into said hot fiber to effect threadline oxidative chain scission degradation of said fiber; and D. quenching and finishing the resulting partially-degraded spun fiber to obtain a spun fiber having a highly degraded surface zone of low molecular weight and low birefringence; and a minimally degraded, essentially crystalline birefringent inner configuration; said inner configuration and said degrade surface zone defining an intermediate zone having a gradation in oxidative degradation.

60. The process according to claim 59, wherein the antioxidant; stabilizer composition comprises a hindered phenolic compound.

61. The process according to claim 59, wherein the polyolefin component of the dry spun melt mixture comprises polypropylene having a molecular weight distribution of at leas about 5.5.

62. The process according to claim 59, wherein the antioxidant/stabilizer composition comprises at least one of phenylphosphites and a N,N' bis-piperidinyl diamine derivative.

63. The process according to claim 59, wherein the highly degraded surface zone of the spun fiber has a weight average molecular weight of less than about 10,000, and the inner configuration of said spun fiber has a high birefringence and a weight average molecular weight of about 100,000–450,000.

64. The process according to claim 59, wherein the take up and quenching steps are carried out in the presence of an oxidizing environment under hot or ambient temperature.

65. The process according to claim 64, wherein the take up and quenching steps are carried out in the presence of an oxygen/nitrogen mixture varying in ratio by volume from about 100-10/0-90.

66. The process according to claim 59, wherein the fiber comprises a monocomponent or bicomponent fiber.

* * * * *

UNITED STATES PATENT AND TRADEMARK OFFICE

CERTIFICATE OF CORRECTION

PATENT NO. : 5,281,378

DATED : January 25, 1994

INVENTOR(S) : Randall E. Kozulla

It is certified that error appears in the above-indentified patent and that said Letters Patent is hereby corrected as shown below:

Column 2, line 44, "surface o the fiber," should read —surface of the fiber,—.

Column 3, line 44, "1076 or 1425" should read —1076(*) or 1425(*)—;

Column 4, line 2, "by LK the" should read —by the—.

Column 4, line 27, "spinning Z11190 temperature" should read —spinning temperature—.

Column 4, line 45, "FI"G." should read —FIG.—.

Column 4, line 51, "schematic" should read —smectic—.

Column 4, line 59, "int h" should read —in the—.

Column 5, line 9, "s" should read —spin—.

Column 5, line 32 , "000," should read —4,259,399, 4,480,000—.

Column 6, line 19, "strength*" should read —strength*6—.

UNITED STATES PATENT AND TRADEMARK OFFICE

CERTIFICATE OF CORRECTION

PATENT NO. : 5,281,378

DATED : January 25, 1994

INVENTOR(S) : Randall E. Kozulla

It is certified that error appears in the above-indentified patent and that said Letters Patent is hereby corrected as shown below:

Column 8, line 33, "emission" should read —scission—.

Column 11, line 7, "rams/mole," should read —grams/mole,—.

Column 13, line 8, "antioxidant; stabilizer" should read —antioxidant/stabilizer—.

Signed and Sealed this

Thirteenth Day of December, 1994

Bruce Lehman

*Attest:*

BRUCE LEHMAN

*Attesting Officer*

*Commissioner of Patents and Trademarks*